US012291985B2

(12) United States Patent
Wakao et al.

(10) Patent No.: US 12,291,985 B2
(45) Date of Patent: May 6, 2025

(54) CONTROL DEVICE OF EXHAUST SENSOR

(71) Applicants: TOYOTA JIDOSHA KABUSHIKI KAISHA, Toyota (JP); DENSO CORPORATION, Kariya (JP)

(72) Inventors: Kazuhiro Wakao, Susono (JP); Mie Kato, Gotemba (JP); Daisuke Kawai, Kariya (JP)

(73) Assignees: TOYOTA JIDOSHA KABUSHIKI KAISHA, Toyota (JP); DENSO CORPORATION, Kariya (JP)

( * ) Notice: Subject to any disclaimer, the term of this patent is extended or adjusted under 35 U.S.C. 154(b) by 154 days.

(21) Appl. No.: 18/449,090

(22) Filed: Aug. 14, 2023

(65) Prior Publication Data

US 2024/0125264 A1 Apr. 18, 2024

(30) Foreign Application Priority Data

Oct. 12, 2022 (JP) ..... 2022-163899

(51) Int. Cl.
*F01N 13/00* (2010.01)

(52) U.S. Cl.
CPC ..... *F01N 13/008* (2013.01); *F01N 2560/20* (2013.01)

(58) Field of Classification Search
CPC ..... F01N 13/008; F01N 2560/20
See application file for complete search history.

(56) References Cited

U.S. PATENT DOCUMENTS 6,812,436 B2 * 11/2004 Nomura ..... F02D 41/1476 219/202

FOREIGN PATENT DOCUMENTS

JP 2004-232647 A 8/2004
JP 2005-083338 A 3/2005

* cited by examiner

*Primary Examiner* — Freddie Kirkland, III
(74) *Attorney, Agent, or Firm* — Oblon, McClelland, Maier & Neustadt, L.L.P.

(57) ABSTRACT

The control device of an exhaust sensor includes a processor. The processor is configured to control supply of power to the heater. The processor is configured to start the supply of power to the heater at a predetermined timing before a starter for cranking the internal combustion engine is turned on and increase power supplied to the heater when the starter is turned on.

6 Claims, 10 Drawing Sheets

CONTROL DEVICE OF EXHAUST SENSOR

FIELD

The present disclosure relates to a control device of an exhaust sensor.

BACKGROUND

In the past, in order to reduce exhaust emissions, etc., it has been known to provide an exhaust sensor for detecting a concentration of a specific component in exhaust gas in an exhaust passage of an internal combustion engine. In such an exhaust sensor, a heater is used to heat a sensor element so as to maintain the sensor element in an activated state.

In order to quickly activate a sensor element, it is desirable to preheat the sensor element before starting the internal combustion engine. PTL 1 describes starting the preheating when an ignition switch is turned on while PTL 2 describes starting the preheating when a vehicle door changes from a locked state to an unlocked state.

CITATIONS LIST

Patent Literature

[PTL 1] Japanese Unexamined Patent Publication No. 2005-083338

[PTL 2] Japanese Unexamined Patent Publication No. 2004-232647

SUMMARY

Technical Problem

However, if performing preheating, the power consumed before the start of the internal combustion engine increases. In particular, if the time from when the preheating is started to when the internal combustion engine is started is long, the power consumed in the preheating becomes excessive. As a result, a voltage of a battery supplying power to a starter falls and the startability of the internal combustion engine is liable to deteriorate.

Therefore, in consideration of the above problem, an object of the present disclosure is to enable quick activation of a sensor element by preheating while keeping the power consumed at the preheating from becoming excessive.

Solution to Problem

The summary of the present disclosure is as follows.

(1) A control device of an exhaust sensor controlling an exhaust sensor provided with a sensor element and a heater for heating that sensor element and arranged in an exhaust passage of an internal combustion engine, comprising: a processor configured to control supply of power to the heater, start the supply of power to the heater at a predetermined timing before a starter for cranking the internal combustion engine is turned on, and increase power supplied to the heater when the starter is turned on.

(2) The control device of an exhaust sensor described in above item (1), wherein the predetermined timing is when an ignition switch is turned on.

(3) The control device of an exhaust sensor described in above item (1) or (2), wherein the processor is configured to decrease the power supplied to the heater or stop the supply of power to the heater when a predetermined start delay condition is satisfied between time when the supply of power to the heater is started and time when the starter is turned on.

(4) The control device of an exhaust sensor described in above item (3), wherein the start delay condition is that the starter has not been turned on for equal to or greater than a predetermined time since the supply of power to the heater was started.

(5) The control device of an exhaust sensor described in above item (3), wherein the start delay condition is that a door of a vehicle mounting the internal combustion engine is opened after the supply of power to the heater is started.

(6) The control device of an exhaust sensor described in above item (1) or (2), wherein the processor is configured to acquire a voltage of a battery supplying power to the starter, stop the supply of power to the heater if the voltage of the battery is equal to or less than a predetermined first threshold value at the predetermined timing, and stop the supply of power to the heater if the voltage of the battery is equal to or less than a predetermined second threshold value when the starter is turned on, and the second threshold value is lower than the first threshold value.

According to the present disclosure, it is possible to enable quick activation of a sensor element by preheating while keeping the power consumed at the preheating from becoming excessive.

DESCRIPTION OF EMBODIMENTS

Below, embodiments of the present disclosure will be explained with reference to the drawings. Note that, in the following explanation, similar component elements will be assigned the same reference notations.

First Embodiment

A first embodiment of the present disclosure will now be explained, with reference to FIG. 1 to FIG. 7.

<Explanation of Internal Combustion Engine Overall>

Figure 1:
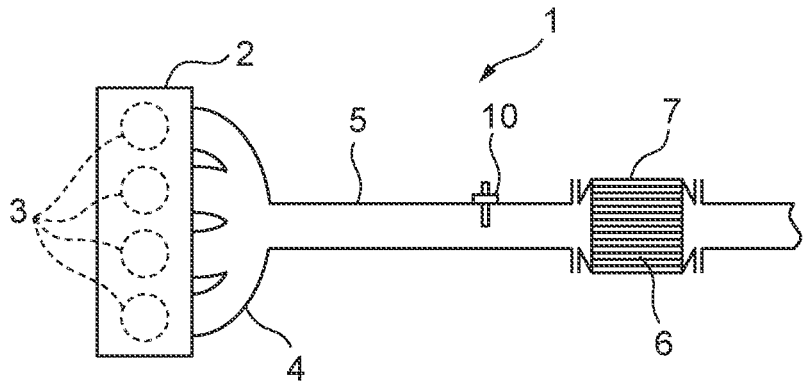
FIG. 1 is a view schematically showing an internal combustion engine to which a control device of an exhaust sensor according to a first embodiment of the present disclosure is applied.

FIG. 1 is a view schematically showing an internal combustion engine 1 to which a control device of an exhaust sensor according to the first embodiment of the present disclosure is applied. The internal combustion engine 1 shown in FIG. 1 is a spark ignition type internal combustion engine, specifically a gasoline engine fueled by gasoline. The internal combustion engine 1 is mounted in a vehicle and functions as a power source for the vehicle.

The internal combustion engine 1 is provided with an engine body 2. The engine body 2 is formed with a plurality of (for example four) cylinders 3. An exhaust manifold 4 is connected to the engine body 2. The exhaust manifold 4 is connected through an exhaust pipe 5 to a casing 7 housing a catalyst 6. The catalyst 6 is, for example, a three-way catalyst able to simultaneously remove hydrocarbons (HC), carbon monoxide (CO), and nitrogen oxides (Nox) from the exhaust gas. The exhaust manifold 4 and the exhaust pipe 5 form an exhaust passage for discharge of exhaust gas generated due to combustion of the air-fuel mixture in the cylinders 3. Note that, in FIG. 1, the intake passages for guiding air to the cylinders 3 are omitted.

<Explanation of Exhaust Sensor>

In the present embodiment, the internal combustion engine 1 is provided with an air-fuel ratio sensor 10 as an exhaust sensor for detecting a specific component of exhaust gas. The air-fuel ratio sensor 10 is arranged in an exhaust passage of the internal combustion engine 1. Specifically, as shown in FIG. 1, the air-fuel ratio sensor 10 is arranged in the exhaust pipe 5 further to the upstream side than the catalyst 6. The air-fuel ratio sensor 10 detects the oxygen concentration in the exhaust gas to linearly detect the air-fuel ratio of the exhaust gas.

Figure 2:
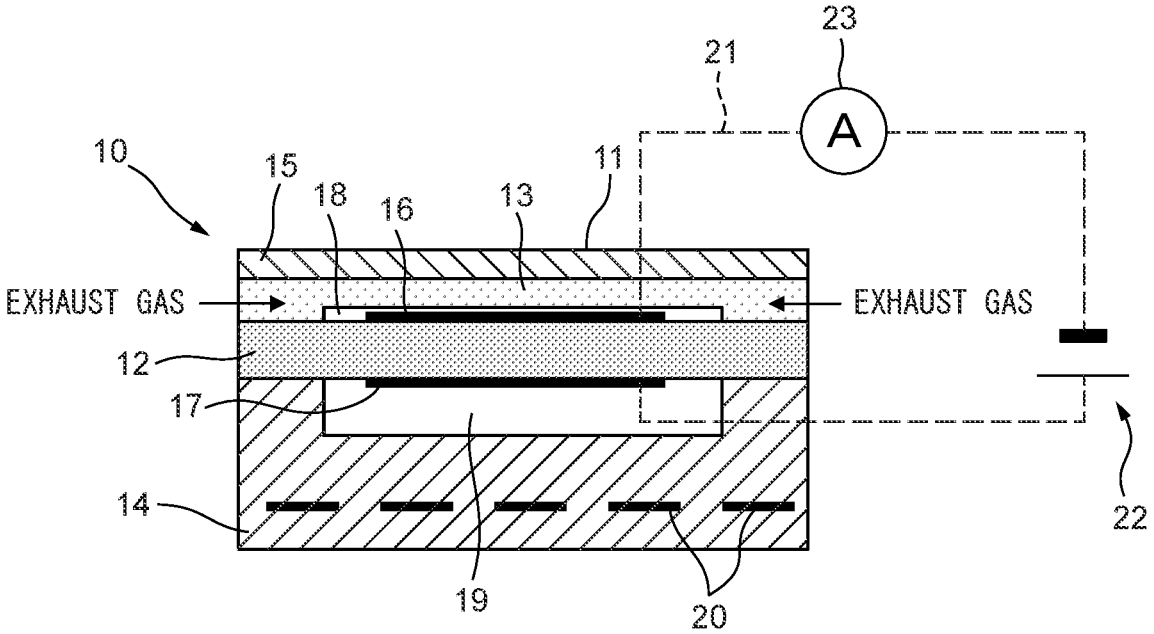
FIG. 2 is a partial cross-sectional view of an air-fuel ratio sensor of FIG. 1.

Below, the configuration of the air-fuel ratio sensor 10 will be explained in detail. FIG. 2 is a partial cross-sectional view of the air-fuel ratio sensor 10 of FIG. 1. The air-fuel ratio sensor 10 is provided with a sensor element 11 and a heater 20.

In the present embodiment, the air-fuel ratio sensor 10 is a multilayer type air-fuel ratio sensor comprised of a plurality of layers stacked together. As shown in FIG. 2, the sensor element 11 has a solid electrolyte layer 12, a diffusion limiting layer 13, a first impermeable layer 14, a second impermeable layer 15, an exhaust side electrode 16, and an atmosphere side electrode 17. The solid electrolyte layer 12, the exhaust side electrode 16, and the atmosphere side electrode 17 form a sensor cell which is an electrochemical cell.

The layers of the sensor element 11 are comprised of, stacked from the bottom in FIG. 2, the first impermeable layer 14, the solid electrolyte layer 12, the diffusion limiting layer 13, and the second impermeable layer 15. Between the solid electrolyte layer 12 and the diffusion limiting layer 13, a measured gas chamber 18 is formed, while between the solid electrolyte layer 12 and the first impermeable layer 14, an atmosphere chamber 19 is formed. That is, the measured gas chamber 18 is defined by the solid electrolyte layer 12 and the diffusion limiting layer 13, while the atmosphere chamber 19 is defined by the solid electrolyte layer 12 and the first impermeable layer 14.

The measured gas chamber 18 is communicated with the exhaust passage of the internal combustion engine through the diffusion limiting layer 13. The exhaust gas flowing through the exhaust passage of the internal combustion engine is introduced to the measured gas chamber 18 as measured gas. On the other hand, the atmosphere chamber 19 is opened to the atmosphere. The atmosphere is introduced into the atmosphere chamber 19.

The solid electrolyte layer 12 is a sheet member having oxide ion conductivity. The solid electrolyte layer 12 is, for example, a sintered member comprised of $ZrO_2$ (zirconia), $HfO_2$, $ThO_2$, $Bi_2O_3$, etc., into which CaO, MgO, $Y_2O_3$, or $Yb_2O_3$ is added as a stabilizer. The diffusion limiting layer 13 is a sheet member having gas permeability. The diffusion limiting layer 13 is, for example, comprised of alumina, magnesia, silica, spinel, mullite, or other porous ceramic. The first impermeable layer 14 and the second impermeable layer 15 are gas impermeable sheet members and, for example, are comprised of alumina.

The exhaust side electrode 16 is arranged on one side surface (measured gas chamber 18 side) of the solid electrolyte layer 12 so as to be exposed to the measured gas inside of the measured gas chamber 18, that is, the exhaust gas flowing through the exhaust passage of the internal combustion engine. On the other hand, the atmosphere side electrode 17 is arranged on the other side surface (atmosphere chamber 19 side) of the solid electrolyte layer 12 so as to be exposed to the atmosphere inside of the atmosphere chamber 19. The exhaust side electrode 16 and the atmosphere side electrode 17 are arranged so as to face each other across the solid electrolyte layer 12. The exhaust side electrode 16 and the atmosphere side electrode 17 are respectively comprised of platinum (Pt) or other precious metals having high catalytic activity. For example, the exhaust side electrode 16 and the atmosphere side electrode 17 are porous cermet electrodes containing Pt as their main constituents.

The heater 20 is arranged inside the sensor element 11 and heats the sensor element 11. In the present embodiment, the heater 20 is buried in the first impermeable layer 14. The heater 20 is, for example, a cermet sheet member containing platinum (Pt) and a ceramic (for example, alumina, etc.) and a heating element generating heat by powering.

As shown in FIG. 2, an electrical circuit 21 is connected to the exhaust side electrode 16 and the atmosphere side electrode 17 of the sensor element 11. The electrical circuit 21 has a voltage application circuit 22 and a current detection circuit 23.

The voltage application circuit 22 is connected to the sensor element 11 and applies voltage to the sensor element 11. Specifically, the voltage application circuit 22 applies voltage to the sensor element 11 so that the potential of the atmosphere side electrode 17 becomes higher than the potential of the exhaust side electrode 16. Therefore, the exhaust side electrode 16 functions as a negative electrode and the atmosphere side electrode 17 functions as a positive electrode.

The current detection circuit 23 is connected to the sensor element 11. When voltage is applied to the sensor element 11, the current flowing between the exhaust side electrode 16 and the atmosphere side electrode 17, that is, the output current of the sensor element 11 when voltage is applied to the sensor element 11, is detected.

Figure 3:
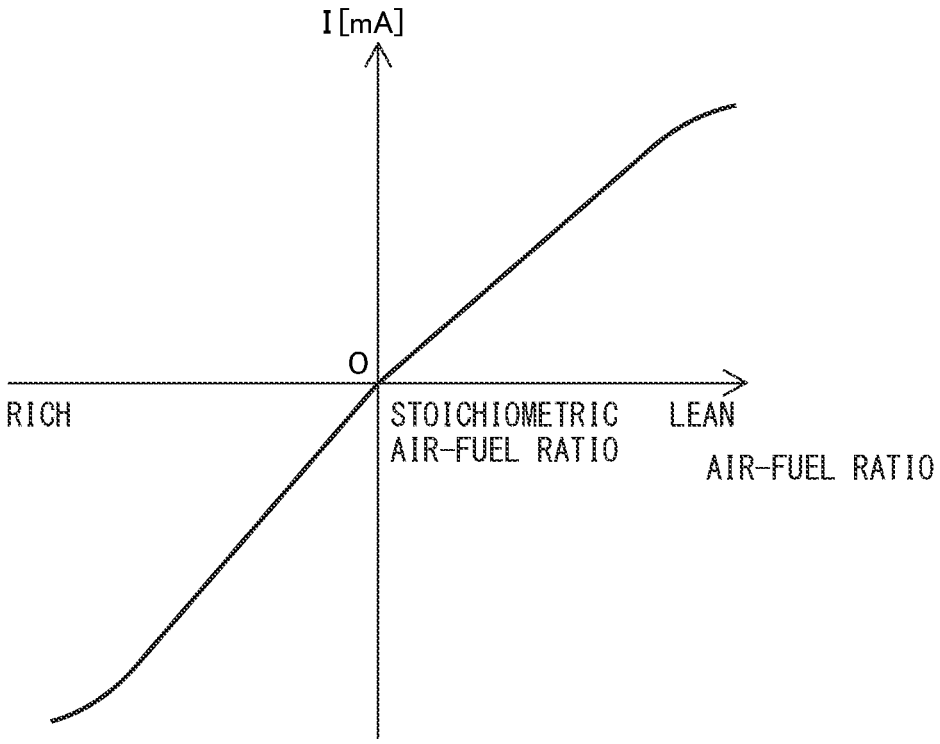
FIG. 3 is a view showing a relationship of an air-fuel ratio of exhaust gas and an output current of a sensor element in an air-fuel ratio sensor.

When voltage is applied to the sensor element 11, oxide ions will move between the exhaust side electrode 16 and the atmosphere side electrode 17 in accordance with the air-fuel ratio of the exhaust gas on the exhaust side electrode 16 and as a result the output current of the sensor element 11 changes in accordance with the air-fuel ratio of the exhaust gas. FIG. 3 is a view showing a relationship of an air-fuel ratio of exhaust gas and an output current I of the sensor element 11 in the air-fuel ratio sensor 10. In the example of FIG. 3, a 0.45V voltage is applied to the sensor element 11.

As will be understood from FIG. 3, when the air-fuel ratio of the exhaust gas is the stoichiometric air-fuel ratio, the output current I becomes zero. Further, in the air-fuel ratio sensor 10, the higher the oxygen concentration of the exhaust gas, i.e., the leaner the air-fuel ratio of the exhaust gas, the greater the output current I becomes. Therefore, the air-fuel ratio sensor 10 can continuously (linearly) detect the air-fuel ratio of the exhaust gas.

<Control Device of Exhaust Sensor>

Figure 4:
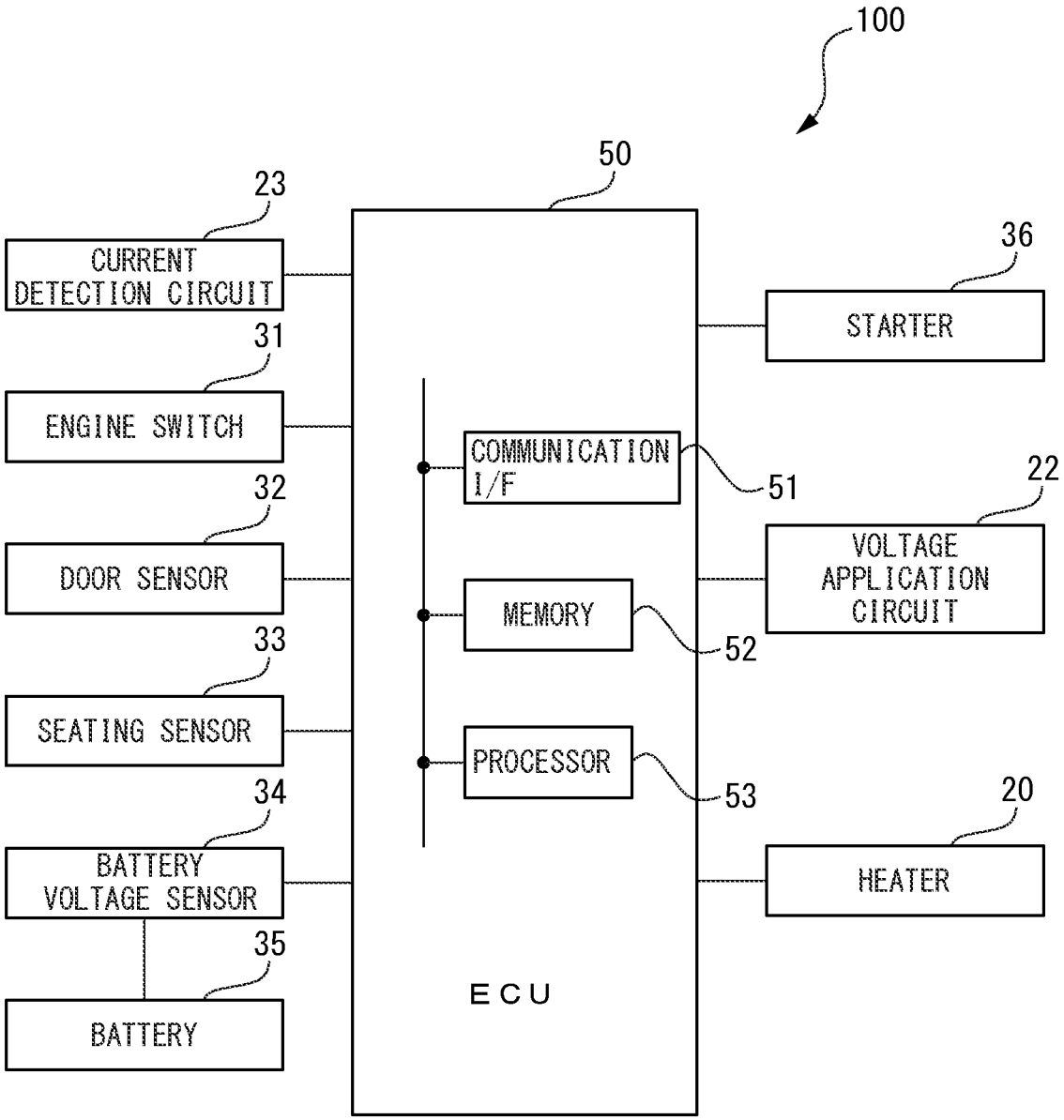
FIG. 4 is a block diagram showing a part of the configuration of a vehicle in which a control device of an exhaust sensor according to a first embodiment of the present disclosure is provided.

FIG. 4 is a block diagram showing a part of the configuration of a vehicle 100 in which a control device of an exhaust sensor according to the first embodiment of the present disclosure is provided. As shown in FIG. 4, the vehicle 100 is provided with an electronic control unit (ECU) 50. The ECU 50 has a communication interface 51, a memory 52, and a processor 53. The communication interface 51 and the memory 52 are connected to the processor 53 through signal wires. Note that, in the present embodiment, a single ECU 50 is provided, but a plurality of ECUs may be provided for the different functions.

The communication interface 51 has an interface circuit for connecting the ECU 50 to an internal vehicle network compliant with the CAN (Controller Area Network) or other standard. The ECU 50 communicates with vehicle-mounted devices connected to the internal vehicle network through the communication interface 51 and internal vehicle network.

The memory 52, for example, has a volatile semiconductor memory (for example RAM) and nonvolatile semiconductor memory (for example ROM). The memory 52 stores a computer program to be executed by the processor 53 and various data etc., used when the processor 53 performs the various processing. Note that, the computer program executed by the processor 53 may be supplied in a form stored in a recording medium able to be read by a computer. The recording medium able to be read by a computer is, for example, a magnetic recording medium, an optical recording medium, or a semiconductor memory.

The processor 53 has one or more CPUs (central processing units) and their peripheral circuits and performs various types of processing. Note that, the processor 53 may further have other processing circuits such as a logical processing unit, an arithmetic processing unit, or a graphic processing unit.

The ECU 50 performs various types of control based on the outputs of various types of sensors, etc., provided at the vehicle 100 or the internal combustion engine 1. In the present embodiment, the current detection circuit 23, an engine switch 31, a door sensor 32, a seating sensor 33, and a battery voltage sensor 34 are electrically connected to the ECU 50. The outputs of these are input to the ECU 50.

The engine switch 31 is arranged near the steering wheel of the vehicle 100 and is operated by the driver of the vehicle 100. If the engine switch 31 is operated by the driver, the switch position of the engine switch 31 is switched between "ACC (accessory) on", "ignition on", "starter on", and "power off". The engine switch 31 outputs signals corresponding to the switch position. When the switch position is "ACC on", the ACC power source is turned on. When the switch position is "ignition on", the ignition switch is turned on. When the switch position is "starter on", the later explained starter 36 is turned on.

The engine switch 31 is, for example, a turn operation type of key switch or a push operation type of button switch. If the engine switch 31 is the button switch, when the driver steps on a brake pedal while pushing the button, the switch position of the engine switch 31 is consecutively changed from "ignition on" to "starter on". Note that, the engine switch 31 may be a portable type switch able to communicate with the ECU 50.

The door sensor 32 detects opening or closing of the door of the vehicle 100. The seating sensor 33 is provided at the driver's seat of the vehicle 100 and detects whether the driver of the vehicle 100 is seated at the driver's seat. The battery voltage sensor 34 detects the voltage of the battery 35 supplying power to the electrical components of the vehicle 100.

Further, in the present embodiment, the starter (cell motor) 36, the voltage application circuit 22, and the heater 20 are electrically connected to the ECU 50. The ECU 50 controls these. The starter 36 cranks the internal combustion engine 1. Specifically, the starter 36 drives rotation of the crankshaft of the internal combustion engine 1 to raise the engine speed before combustion of the air-fuel mixture is started in the internal combustion engine 1. If the switch position of the engine switch 31 is "starter on", the ECU 50 turns the starter 36 on to make the starter 36 start.

The ECU 50 controls the voltage applied to the sensor element 11 through the voltage application circuit 22. For example, the ECU 50 applies a voltage within a limit current region (0.15V to 0.7V), for example 0.45V, by which the output current does not change much at all even if the applied voltage changes, to the sensor element 11 after the start of the internal combustion engine 1.

Figure 5:
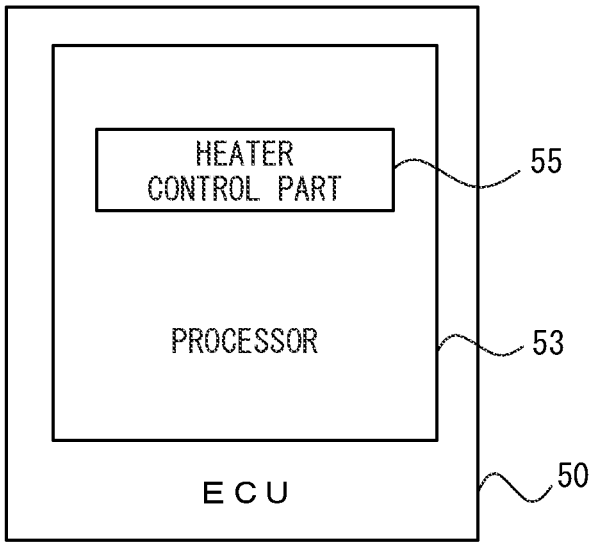
FIG. 5 is a functional block diagram of a processor of an ECU in the first embodiment.

FIG. 5 is a functional block diagram of a processor 53 of an ECU 50 in the first embodiment. In the present embodiment, the ECU 50 functions as a control device of an exhaust sensor, and the processor 53 has a heater control part 55. The heater control part 55 is a function module realized by a computer program stored in the memory 52 of the ECU 50 being run by the processor 53 of the ECU 50. Note that, the heater control part 55 may be realized by a dedicated processing circuit provided at the processor 53.

In this regard, to use the air-fuel ratio sensor 10 to precisely detect the air-fuel ratio of the exhaust gas, it is necessary to activate the sensor element 11 of the air-fuel ratio sensor 10. For this reason, the heater control part 55 controls supply of power to the heater 20 and heats the sensor element 11 by the heater 20. At this time, the heater control part 55 supplies power from the battery 35 to the heater 20 through the heater drive circuit and controls the power supplied to the heater 20. For example, the heater control part 55 controls the power supplied to the heater 20 so that the temperature of the sensor element 11 becomes a predetermined target temperature.

In the present embodiment, the heater control part 55 controls the power supplied to the heater 20 by PWM (pulse width modulation) control. In the PWM control, the period (frequency) of the switching is made constant, and by changing the pulse width (on time) of the switching to change the duty ratio, the voltage applied to the heater 20 is controlled. The duty ratio is calculated by dividing the pulse width by the period (duty ratio=pulse width/period) and becomes higher as the pulse width becomes longer. The higher the duty ratio in the PWM control, the larger the power supplied to the heater 20.

For quick activation of the sensor element 11, it is desirable to preheat the sensor element 11 before starting the internal combustion engine 1. However, if preheating, the power consumed before the start of the internal combustion engine 1 increases. In particular, if the time from when preheating is started to when the internal combustion engine 1 is started is long, the power consumed at the preheating becomes excessive. As a result, the voltage of the battery 35 supplying power to the starter 36 falls and the startability of the internal combustion engine 1 is liable to deteriorate.

Therefore, in the present embodiment, the heater control part 55 starts the supply of power to the heater 20 at a predetermined timing before the starter 36 is turned on and increases the power supplied to the heater 20 when the starter 36 is turned on. That is, the heater control part 55 makes the power supplied to the heater 20 before the starter 36 is turned on smaller than the power supplied to the heater 20 after the starter 36 is turned on. By doing this, it is possible to enable quick activation of the sensor element 11 by preheating while keeping the power consumed in the preheating from becoming excessive.

If the ignition switch is turned on at the vehicle 100, there is a high possibility that the starter 36 will be turned on and starting of the internal combustion engine 1 will be demanded within a short time. For this reason, in the present embodiment, the heater control part 55 starts the supply of power to the heater 20 when the ignition switch is turned on. Due to this, it is possible to keep the power consumed at the preheating from being wasted without the internal combustion engine 1 being started up.

In the present embodiment, the heater control part 55 changes the duty ratio in the PWM control of the heater 20 to thereby change the power supplied to the heater 20. Therefore, the heater control part 55 raises the duty ratio when the starter 36 is turned on to thereby increase the power supplied to the heater 20. That is, the heater control part 55 makes the duty ratio before the starter 36 is turned on lower than the duty ratio after the starter 36 is turned on.

<Explanation of Control Using Time Chart>

Figure 6:
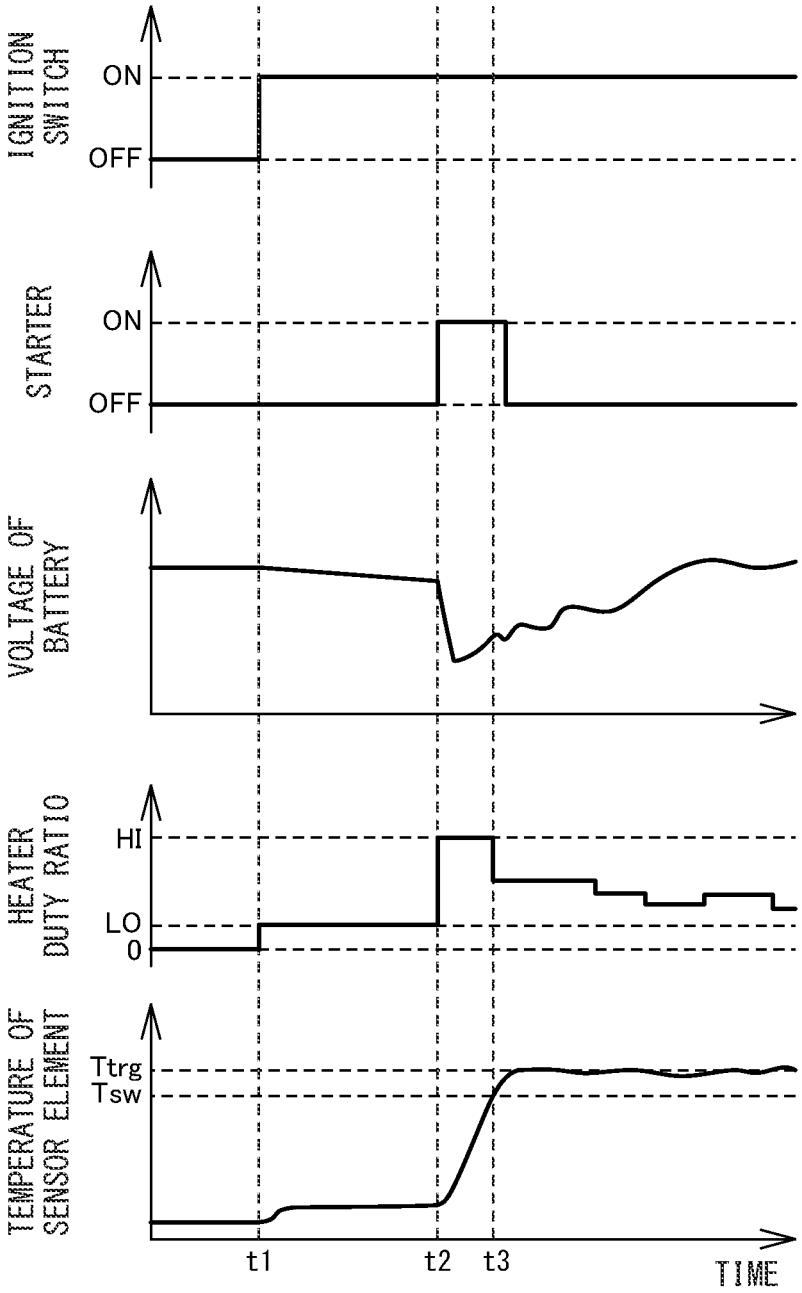
FIG. 6 is a time chart of on/off states, etc., of an ignition switch when heater control in the first embodiment is performed.

Below, referring to the time chart of FIG. 6, the above-mentioned heater control will be specifically explained. FIG. 6 is a time chart of the on/off state of the ignition switch, the on/off state of the starter 36, the voltage of the battery 35, the duty ratio at PWM control of the heater 20, and the temperature of the sensor element 11 when heater control is performed in the first embodiment.

In the illustrated example, at the time t1, the ignition switch is turned on. When the ignition switch is turned on, the supply of power to the heater 20 is started and power is supplied from the battery 35 to the heater 20. When the supply of power to the heater 20 is started, the duty ratio is set to the low power value LO. The duty ratio is maintained at the low power value LO until the starter 36 is turned on.

At the time t1 on, the temperature of the sensor element 11 rises due to the heating of the sensor element 11 by the heater 20. At this time, the duty ratio is set so that the power supplied to the heater 20 becomes smaller, and therefore the power consumed at the preheating becomes smaller and the drop in the voltage of the battery 35 becomes smaller. Therefore, the voltage of the battery 35 can be kept from becoming insufficient and the startability of the internal combustion engine 1 from deteriorating.

After the time t1, at the time t2, the starter 36 is turned on and the duty ratio is switched from the low power value LO to the high power value HI. As a result, the power supplied to the heater 20 becomes larger and a rise in the temperature of the sensor element 11 is promoted. Further, the starter 36 is operated until the engine speed reaches a predetermined speed required for burning the air-fuel mixture. Due to operation of the starter 36, the voltage of the battery 35 falls considerably.

The duty ratio is maintained at the high power value HI after the starter 36 is turned on up until the temperature of the sensor element 11 reaches the predetermined switching temperature Tsw. The switching temperature Tsw is set to a temperature lower than the target temperature Ttrg at which the sensor element 11 is activated. In the present embodiment, preheating is started before the starter 36 is turned on, and therefore the temperature of the sensor element 11 quickly rises and reaches the switching temperature Tsw at the time t3. At the time t3 on, the power supplied to the heater is feedback controlled so that the temperature of the sensor element 11 is maintained at the target temperature Ttrg. Note that, the duty ratio in the feedback control is set to a value lower than the high power value HI.

<Power Supply Processing>

Figure 7:
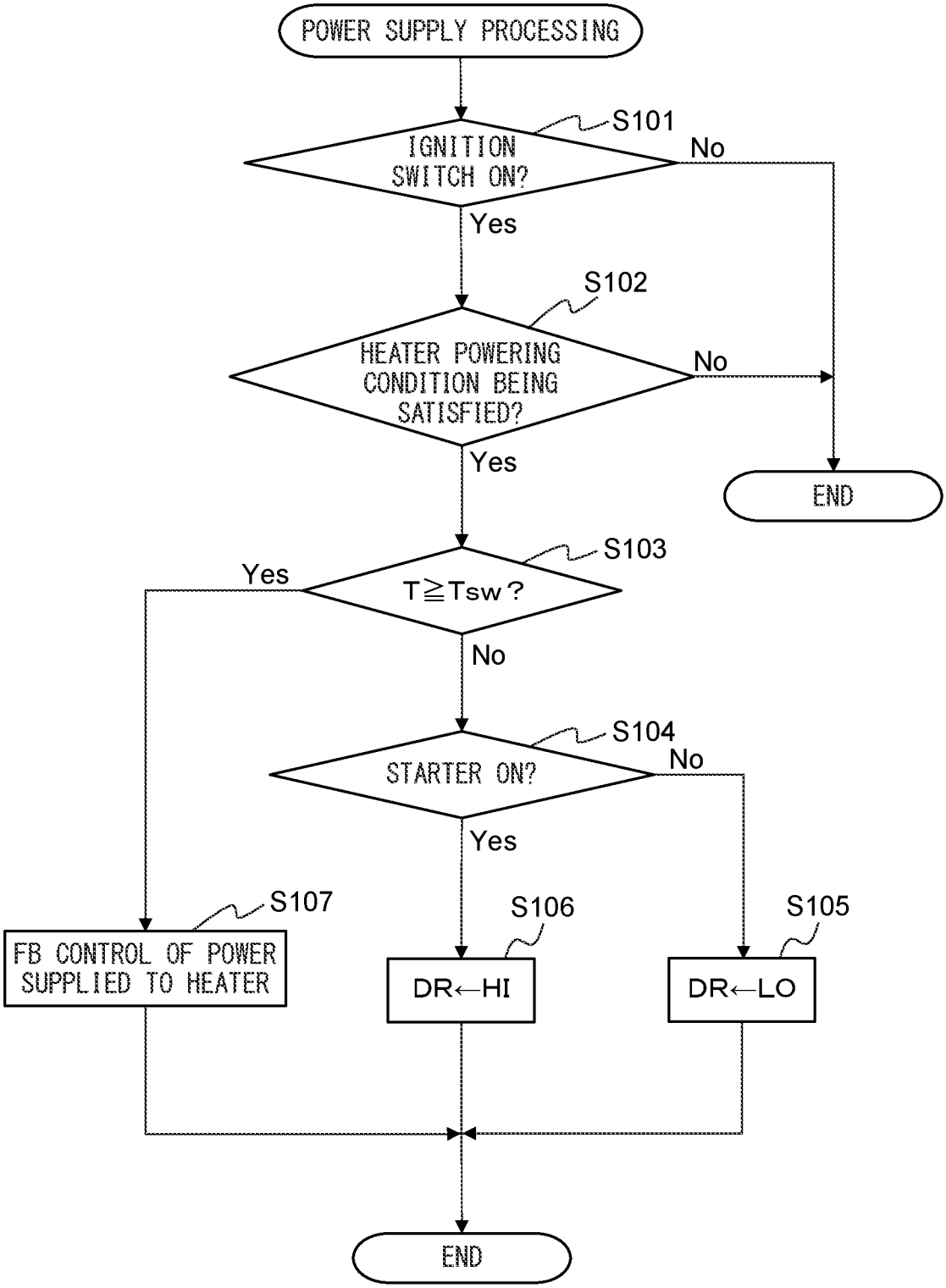
FIG. 7 is a flow chart showing a control routine of power supply processing in the first embodiment of the present disclosure.

Below, referring to the flow chart of FIG. 7, the control for supplying power to the heater 20 will be explained in detail. FIG. 7 is a flow chart showing a control routine of power supply processing in the first embodiment of the present disclosure. The present control routine is repeatedly executed by the ECU 50 at predetermined execution intervals.

First, at step S101, the heater control part 55 judges whether the ignition switch has been turned on based on the output of the engine switch 31. If it is judged that the ignition switch is not turned on, the present control routine ends. On the other hand, if it is judged that the ignition switch has been turned on, the present control routine proceeds to step S102.

At step S102, the heater control part 55 judges whether a predetermined heater powering condition is satisfied. The heater powering condition is a condition for permitting the supply of power to the heater 20, and, for example, is that an abnormality of the air-fuel ratio sensor 10 is not detected. Note that, abnormality diagnosis of the air-fuel ratio sensor 10 is appropriately performed by a known technique. If it is judged that the heater powering condition is not satisfied, the present control routine ends. On the other hand, if it is judged that the heater powering condition is satisfied, the present control routine proceeds to step S103.

At step S103, the heater control part 55 judges whether the temperature T of the sensor element 11 is equal to or greater than the predetermined switching temperature Tsw. The heater control part 55, for example, calculates the temperature of the sensor element 11 based on the impedance of the sensor element 11. The switching temperature Tsw is set to a temperature lower than the target temperature Ttrg of the sensor element 11.

If at step S103 it is judged that the temperature T of the sensor element 11 is less than the switching temperature Tsw, the present control routine proceeds to step S104. At step S104, the heater control part 55 judges whether the starter 36 has been turned on based on the output of the engine switch 31. If it is judged that the starter 36 has not been turned on, the present control routine proceeds to step S105.

At step S105, the heater control part 55 sets the duty ratio DR at the PWM control of the heater 20 to the low power value LO and supplies power to the heater 20. The low power value LO is determined in advance and, for example, is set to 10% to 30%. After step S105, the present control routine ends.

On the other hand, if at step S104 it is judged that the starter 36 has been turned on, the present control routine proceeds to step S106. At step S106, the heater control part 55 sets the duty ratio DR to the high power value HI and supplies power to the heater 20. The high power value HI is determined in advance as a value higher than the low power value LO and, for example, is set to 50% to 70%. After step S106, the present control routine ends.

Further, if at step S103 it is judged that the temperature T of the sensor element 11 is equal to or greater than the switching temperature Tsw, the present control routine proceeds to step S107. At step S107, the heater control part 55 feedback controls the power supplied to the heater 20 so that the temperature T of the sensor element 11 is maintained at the predetermined target temperature Ttrg. In the present embodiment, the heater control part 55 feedback controls the duty ratio DR so that the temperature T of the sensor element 11 is maintained at the predetermined target temperature Ttrg. The target temperature Ttrg is determined in advance as the temperature at which the sensor element 11 is activated. After step S107, the present control routine ends.

Note that, at step S101, the heater control part 55 may judge whether the driver of the vehicle 100 has sat at the driver's seat based on the output of the seating sensor 33. That is, the predetermined timing at which the supply of power to the heater 20 is started may be when the driver of the vehicle 100 sit at the driver's seat. Further, at step S101, the heater control part 55 may judge whether the door of the vehicle 100 has been opened at the state in which the driver of the vehicle 100 is not sitting at the driver's seat based on the outputs of the door sensor 32 and the seating sensor 33. That is, the predetermined timing at which the supply of power to the heater 20 is started may be when the door of the vehicle 100 is opened at the state in which the driver of the vehicle 100 is not sitting at the driver's seat. Further, at step S101, the heater control part 55 may judge whether the door of the vehicle 100 changes from a locked state to an unlocked state. That is, the predetermined timing at which the supply of power to the heater 20 is started may be when the door of the vehicle 100 changes from a locked state to an unlocked state.

Second Embodiment

The control device of an exhaust sensor according to a second embodiment is basically similar in configuration and control to the control device of an exhaust sensor according to the first embodiment except for the points explained below. For this reason, below, the second embodiment of the present disclosure will be explained focusing on the parts different from the first embodiment.

As explained above, the heater control part 55 starts the supply of power to the heater 20 at a predetermined timing before the starter 36 is turned on and increases the power supplied to the heater 20 when the starter 36 is turned on. However, the starter 36 is not necessarily quickly turned on after a predetermined timing.

Therefore, in the second embodiment, if a predetermined start delay condition is satisfied between the time when the supply of power to the heater 20 is started and the time when the starter 36 is turned on, the heater control part 55 decreases the power supplied to the heater 20 or stops the supply of power to the heater 20. Due to this, it is possible to prevent power from being wasted when the internal combustion engine 1 is not started.

The start delay condition is the condition which is satisfied when there is a high possibility of starting of the internal combustion engine 1 being delayed. For example, the starter 36 is not turned on for equal to or greater than a predetermined time from when the supply of power to the heater 20. In the present embodiment, the heater control part 55 starts the supply of power to the heater 20 when the ignition switch is turned on, and decreases the power supplied to the heater 20 if the starter 36 is not turned on for equal to or greater than a predetermined time after the ignition switch is turned on. For example, the heater control part 55 switches the duty ratio at the PWM control of the heater 20 from a low power value LO to a second low power value LO2 lower than the low power value LO when a predetermined time has elapsed from when the ignition switch is turned on.

Figure 8:
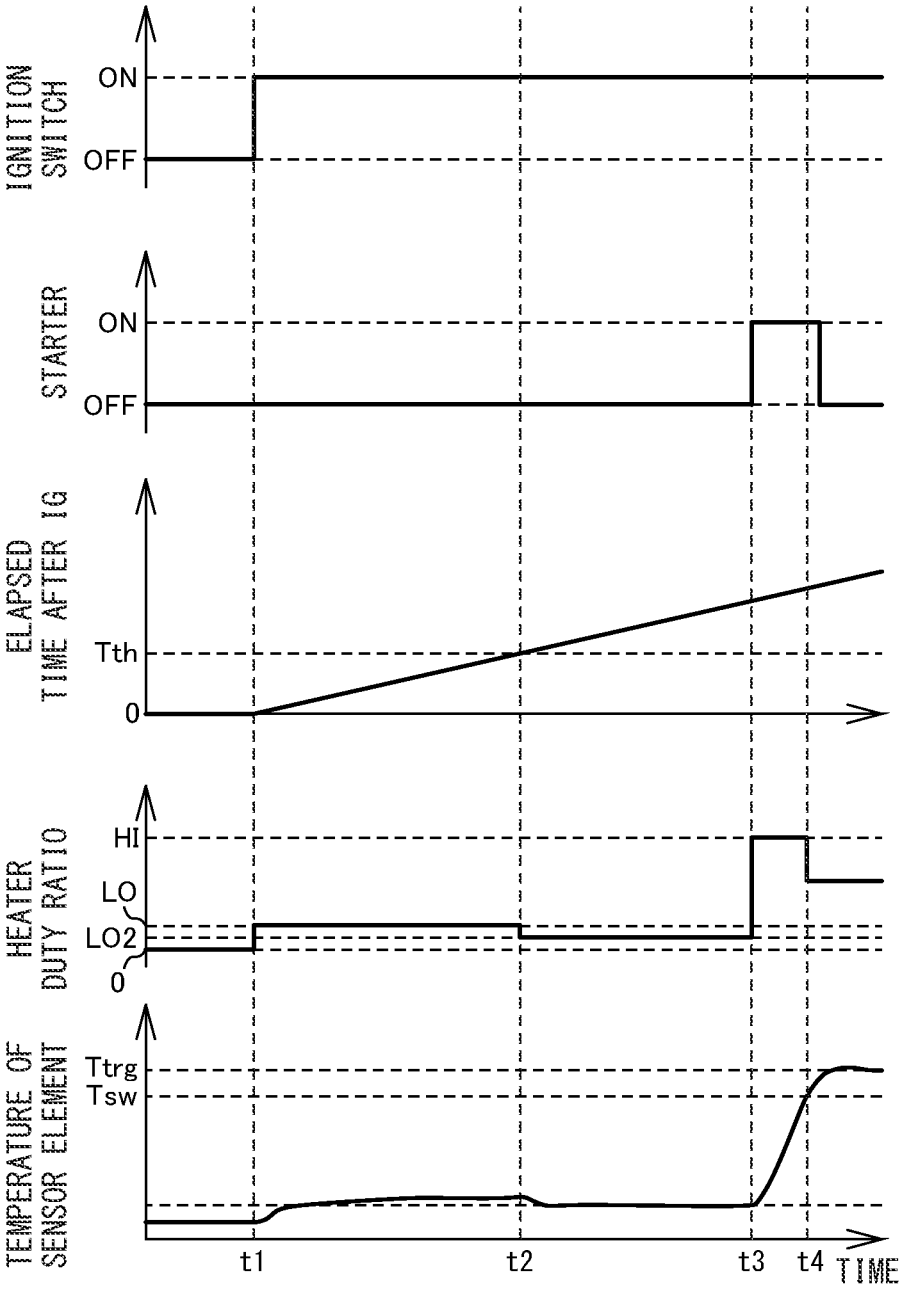
FIG. 8 is a time chart of on/off states, etc., of an ignition switch when heater control in a second embodiment is performed.

Below, referring to the time chart of FIG. 8, the heater control in the second embodiment will be explained in detail. FIG. 8 is a time chart of the on/off state of the ignition switch, the on/off state of the starter 36, the elapsed time from when the ignition switch is turned on, and the duty ratio and temperature of the sensor element 11 in PWM control of the heater 20 when heater control in the second embodiment is performed.

In the illustrated example, at the time t1, the ignition switch is turned on. When the ignition switch is turned on, the supply of power to the heater 20 is started and power is supplied from the battery 35 to the heater 20. When the supply of power to the heater 20 is started, the duty ratio is set to the low power value LO.

From the time t1 on, although the temperature of the sensor element 11 rises due to heating of the sensor element 11 of the heater 20, in this example, the ignition switch and the starter 36 are not consecutively turned on and the state where the starter 36 is turned off is maintained. When at the time t2 the elapsed time from when the ignition switch is turned on reaches a predetermined time Tth, the start delay condition is satisfied. For this reason, at the time t2, the duty ratio is switched from the low power value LO to the second low power value LO2 to decrease the power supplied to the heater 20. As a result, the temperature of the sensor element 11 is maintained at substantially the same temperature and power is kept from being wasted.

After the time t2, at the time t3, the starter 36 is turned on and the duty ratio is switched from the second low power value LO2 to the high power value HI. As a result, the power supplied to the heater 20 becomes greater and a temperature rise of the sensor element 11 is promoted. At the time t4, when the temperature of the sensor element 11 reaches the switching temperature Tsw, from the time t4 on, the power supplied to the heater is feedback controlled so that the temperature of the sensor element 11 is maintained at the target temperature Ttrg.

Figure 9:
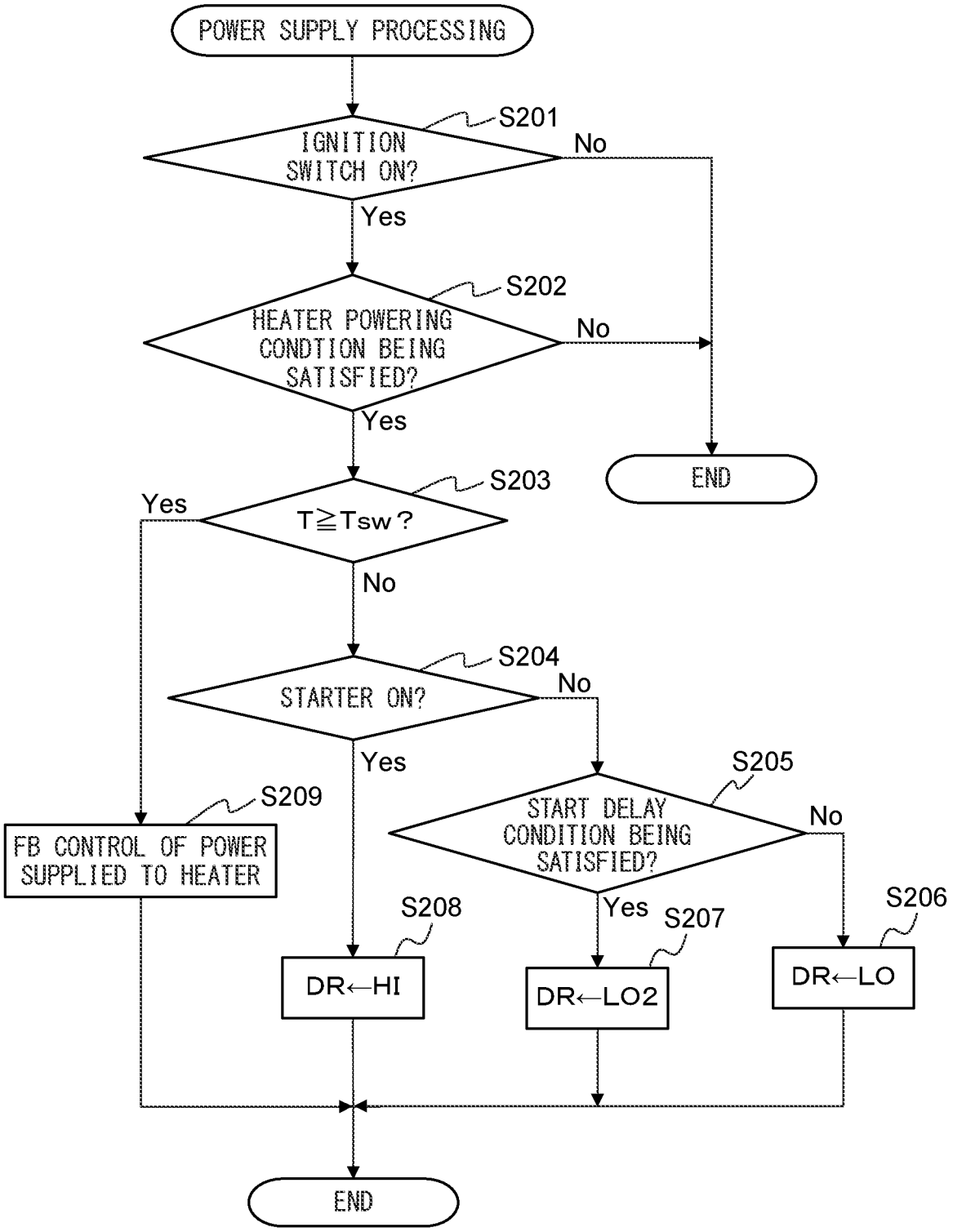
FIG. 9 is a flow chart showing a control routine of power supply processing in the second embodiment of the present disclosure.

FIG. 9 is a flowchart showing a control routine of power supply processing in the second embodiment of the present disclosure. The present control routine is repeatedly executed by the ECU 50 at predetermined execution intervals.

Steps S201 to S204 are performed in the same way as steps S101 to S104 of FIG. 7. If at step S204 it is judged that the starter 36 has not been turned on, the present control routine proceeds to step S205.

At step S205, the heater control part 55 judges whether the start delay condition is satisfied. The start delay condition is, for example, that the starter 36 has not been turned on for equal to or greater than a predetermined time since the supply of power to the heater 20 was started, that is, that equal to or greater than a predetermined time has elapsed since the ignition switch was turned on.

If at step S205 it is judged that the start delay condition is not satisfied, the present control routine proceeds to step S206. At step S206, the heater control part 55 sets the duty ratio DR at the PWM control of the heater 20 to the low power value LO and supplies power to the heater 20. The low power value LO is determined in advance and, for example, is set to 10% to 30%. After step S206, the present control routine ends.

On the other hand, if at step S205 it is judged that the start delay condition is satisfied, the present control routine proceeds to step S207. At step S207, the heater control part 55 sets the duty ratio DR to the second low power value LO2 and supplies power to the heater 20. The second low power value LO2 is determined in advance as a value lower than the low power value LO and, for example, is set to 5% to 20%. After step S207, the present control routine ends.

Further, if at step S204 it is judged that the starter 36 is turned on, the present control routine proceeds to step S208. At step S208, the heater control part 55 sets the duty ratio DR to the high power value HI and supplies power to the heater 20. The high power value HI is determined in advance as a value higher than the low power value LO and, for example, is set to 50% to 70%. After step S208, the present control routine ends.

Further, if at step S203 it is judged that the temperature T of the sensor element 11 is equal to or greater than the switching temperature Tsw, the present control routine proceeds to step S209. At step S209, in the same way as step S107 of FIG. 7, the heater control part 55 feedback controls the power supplied to the heater 20 so that the temperature T of the sensor element 11 is maintained at a predetermined target temperature Ttrg. After step S209, the present control routine ends.

Note that, at step S205, the heater control part 55 may judge whether the door of the vehicle 100 has been opened after the ignition switch was turned on based on the output of the door sensor 32. That is, the start delay condition may be that the door of the vehicle 100 is opened after the supply of power to the heater 20 is started. Further, at step S205, the heater control part 55 may judge whether the driver of the vehicle 100 has left the driver's seat after the ignition switch was turned on based on the output of the seating sensor 33. That is, the start delay condition may be that the driver of the vehicle 100 leaves the driver's seat after the supply of power to the heater 20 is started.

Further, at step S207, the heater control part 55 may feedback control the power supplied to the heater 20 so that the temperature T of the sensor element 11 is maintained at a predetermined temperature lower than the switching temperature Tsw. The predetermined temperature is, for example, set to the temperature of the sensor element 11 at the time of start of the starter 36 when the ignition switch and the starter 36 are consecutively turned on.

Further, at step S207, the heater control part 55 may stop the supply of power to the heater 20. Furthermore, the control routine of FIG. 9 can be modified in the same way as the control routine of FIG. 7.

Third Embodiment

The control device of an exhaust sensor according to a third embodiment is basically similar in configuration and control to the control device of an exhaust sensor according to the first embodiment except for the points explained below. For this reason, below, the third embodiment of the present disclosure will be explained focusing on the parts different from the first embodiment.

Figure 10:
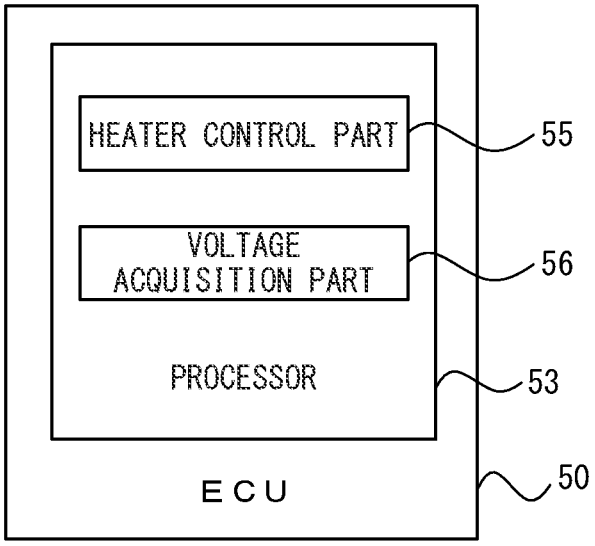
FIG. 10 is a functional block diagram of a processor of an ECU in a third embodiment.

FIG. 10 is a functional block diagram of the processor 53 of the ECU 50 in the third embodiment. In the third embodiment, the processor 53 has a voltage acquisition part 56 in addition to the heater control part 55. The heater control part 55 and the voltage acquisition part 56 are function modules realized by a computer program stored in the memory 52 of the ECU 50 being run by the processor 53 of the ECU 50. Note that, the heater control part 55 and the voltage acquisition part 56 may be realized by dedicated processing circuits provided at the processor 53.

The voltage acquisition part 56 acquires the voltage of the battery 35 supplying power to the starter 36. For example, the voltage acquisition part 56 acquires the voltage of the battery 35 based on the output of the battery voltage sensor 34.

In the cranking of the internal combustion engine 1, a large amount of power is consumed, and therefore the voltage of the battery 35 has to be maintained high until cranking is started. For this reason, in the third embodiment, the heater control part 55 stops the supply of power to the heater 20 if the voltage of the battery 35 is equal to or less than the predetermined first threshold value at a predetermined timing at which the supply of power to the heater 20 is started. For example, the heater control part 55 stops the supply of power to the heater 20 if the voltage of the battery 35 is equal to or less than the first threshold value when the ignition switch is turned on. By doing this, when the voltage of the battery 35 is insufficient, it is possible to suppress deterioration of the startability of the internal combustion engine 1 due to preheating.

On the other hand, after cranking is started, the required value of the voltage of the battery 35 becomes lower compared with before cranking is started. For this reason, the heater control part 55 stops the supply of power to the heater 20 if the voltage of the battery 35 is equal to or less than a predetermined second threshold value lower than the first threshold value when the starter 36 is turned on. By doing this, it is possible to keep the startability of the internal combustion engine 1 from deteriorating while securing the opportunity for preheating.

Figure 11:
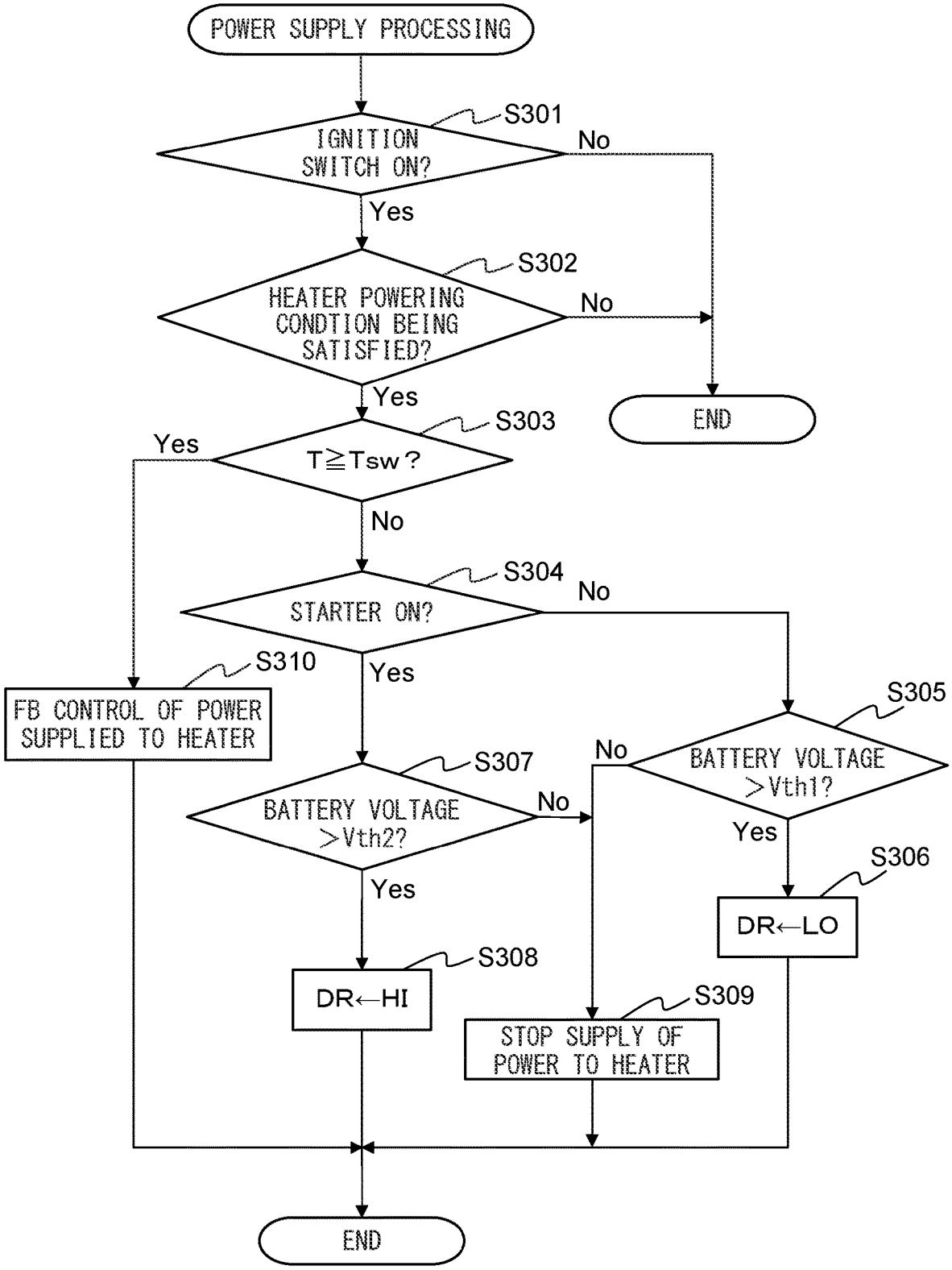
FIG. 11 is a flow chart showing a control routine of power supply processing in the third embodiment of the present disclosure.

FIG. 11 is a flow chart showing a control routine of power supply processing in the third embodiment of the present disclosure. The present control routine is repeatedly executed by the ECU 50 at predetermined execution intervals.

Steps S301 to S304 are performed in the same way as steps S101 to S104 of FIG. 7. If at step S304 it is judged that the starter 36 has been turned on, the present control routine proceeds to step S305.

At step S305, the heater control part 55 judges whether the voltage of the battery 35 acquired by the voltage acquisition part 56 is higher than a first threshold value Vth1. The first threshold value Vth1 is determined in advance and is set to 12V to 13V, for example 12.5V.

If at step S305 it is judged that the voltage of the battery 35 is higher than the first threshold value Vth1, the present control routine proceeds to step S306. At step S306, in the same way as step S105 of FIG. 7, the heater control part 55 sets the duty ratio DR at the PWM control of the heater 20 to the low power value LO and supplies power to the heater 20. After step S306, the present control routine ends.

On the other hand, if at step S304 it is judged that the starter 36 has been turned on, the present control routine proceeds to step S307. At step S307, the heater control part 55 judges whether the voltage of the battery 35 acquired by the voltage acquisition part 56 is higher than a second threshold value Vth2. The second threshold value Vth2 is determined in advance as a value lower than the first threshold value Vth1 and is set to 8V to 10V, for example 9V.

If at step S307 it is judged that the voltage of the battery 35 is higher than the second threshold value Vth2, the present control routine proceeds to step S308. At step S308, in the same way as step S106 of FIG. 7, the heater control part 55 sets the duty ratio DR to the high power value HI and supplies power to the heater 20. After step S308, the present control routine ends.

Further, if at step S305 it is judged that the voltage of the battery 35 is equal to or less than the first threshold value Vth1 or if at step S307 it is judged that the voltage of the battery 35 is equal to or less than the second threshold value Vth2, the present control routine proceeds to step S309. At step S309, the heater control part 55 stops the supply of power to the heater 20, i.e., powering the heater 20. After step S309, the present control routine ends.

Note that, the control routine of FIG. 11 can be modified in the same way as the control routine of FIG. 7.

Other Embodiments

Above, preferred embodiments according to the present disclosure were explained, but the present disclosure is not limited to these embodiments and can be corrected and changed in various ways within the language of the claims. For example, the internal combustion engine to which the control device of an exhaust sensor is applied may be a compression ignition type internal combustion engine (for example, a diesel engine).

Further, the air-fuel ratio sensor 10 may be arranged at another position such as the downstream side of the catalyst 6. Further, the upstream side air-fuel ratio sensor arranged at the upstream side of the catalyst 6 and the downstream side air-fuel ratio sensor arranged at the downstream side of the catalyst 6 may be provided at the internal combustion engine 1 and the control device of the exhaust sensor may be applied for the above heater control to at least one of the upstream side air-fuel ratio sensor and downstream side air-fuel ratio sensor.

Further, as the exhaust sensor controlled by the control device of an exhaust sensor, instead of the air-fuel ratio sensor 10, a nitrogen oxide sensor (NOx sensor) for detecting nitrogen oxides (NOx) in the exhaust gas, an ammonia sensor for detecting the concentration of ammonia in the exhaust gas, an oxygen sensor for detecting whether the air-fuel ratio of the exhaust gas is rich or lean, etc. may be used.

Further, the above embodiments can be worked in any combination. If the second embodiment and the third embodiment are combined, in the control routine of FIG. 11, steps S205 to S207 of FIG. 9 are performed instead of step S306.

REFERENCE SIGNS LIST

1. internal combustion engine
5. exhaust pipe
10. air-fuel ratio sensor
11. sensor element
20. heater
36. starter
50. electronic control unit (ECU)
53. processor
55. heater control part

The invention claimed is:

1. A control device of an exhaust sensor controlling an exhaust sensor provided with a sensor element and a heater for heating that sensor element and arranged in an exhaust passage of an internal combustion engine, comprising:

a processor configured to control supply of power to the heater, start the supply of power to the heater at a predetermined timing before a starter for cranking the internal combustion engine is turned on, and increase power supplied to the heater when the starter is turned on.

2. The control device of an exhaust sensor according to claim 1, wherein the predetermined timing is when an ignition switch is turned on.

3. The control device of an exhaust sensor according to claim 1, wherein the processor is configured to decrease the power supplied to the heater or stop the supply of power to the heater when a predetermined start delay condition is satisfied between time when the supply of power to the heater is started and time when the starter is turned on.

4. The control device of an exhaust sensor according to claim 3, wherein the start delay condition is that the starter has not been turned on for equal to or greater than a predetermined time since the supply of power to the heater was started.

5. The control device of an exhaust sensor according to claim 3, wherein the start delay condition is that a door of a vehicle mounting the internal combustion engine is opened after the supply of power to the heater is started.

6. The control device of an exhaust sensor according to claim 1, wherein the processor is configured to acquire a voltage of a battery supplying power to the starter, stop the supply of power to the heater if the voltage of the battery is equal to or less than a predetermined first threshold value at the predetermined timing, and stop the supply of power to the heater if the voltage of the battery is equal to or less than a predetermined second threshold value when the starter is turned on, and the second threshold value is lower than the first threshold value.

* * * * *